US005596848A

United States Patent [19]

Lynch

[11] Patent Number: 5,596,848

[45] Date of Patent: Jan. 28, 1997

[54] ADJUSTABLE SKYLIGHT

[75] Inventor: Steven Lynch, Five Dock, Australia

[73] Assignee: Skydome Industries Limited, New South Wales, Australia

[21] Appl. No.: 481,281

[22] PCT Filed: Oct. 10, 1994

[86] PCT No.: PCT/AU94/00614

§ 371 Date: Jun. 6, 1995

§ 102(e) Date: Jun. 6, 1995

[87] PCT Pub. No.: WO95/10676

PCT Pub. Date: Apr. 20, 1995

[30] Foreign Application Priority Data

Oct. 11, 1993 [AU] Australia ..... PM1710

[51] Int. Cl.[6] ..... E04B 7/18

[52] U.S. Cl. ..... 52/200; 52/72

[58] Field of Search ..... 52/200, 22, 27, 52/205, 28, 72, 219; 362/147, 148; 248/185.1

[56] References Cited

U.S. PATENT DOCUMENTS

| | | | |
|---|---|---|---|
| 4,733,505 | 3/1988 | Vom Dame | 52/200 X |
| 4,809,468 | 3/1989 | Bareiss | 52/200 X |
| 5,027,566 | 7/1991 | Gilowski | 52/200 X |
| 5,099,622 | 3/1992 | Sutton | 52/200 |
| 5,175,967 | 1/1993 | Greenwood | 52/200 |
| 5,207,036 | 5/1993 | Sampson et al. | 52/200 X |
| 5,355,644 | 10/1994 | Guhl et al. | 52/200 |

*Primary Examiner*—Creighton Smith

*Attorney, Agent, or Firm*—Abelman, Frayne & Schwab

[57] ABSTRACT

An adjustable skylight assembly adapted to suit a variety of roof pitches includes a domed structure having an upper transparent portion and a base by which it is secured to the roof. Within the domed structure, there is an adjustable collar to which is connected a duct for communicating sunlight from the domed structure to a room beneath the roof. The collar can be rotated with respect to the domed structure so that the axis of the collar and the duct can assume a predetermined position regardless of the pitch of the roof.

7 Claims, 7 Drawing Sheets

ADJUSTABLE SKYLIGHT

FIELD OF THE INVENTION

The present invention relates to skylights and, more particularly, to a skylight assembly that is adapted to suit a variety of roofs of different angular pitches.

BACKGROUND ART

Most conventional skylight assemblies are manufactured according to a fixed design to accommodate a particular roof pitch or a narrow range of roof pitches. Such skylight assemblies cannot be easily used or modified to accommodate a wide range of roof pitches, say at angles of from 0 degrees to 45 degrees.

SUMMARY OF THE INVENTION

It is an object of the present invention to provide a skylight assembly that is constructed in such a way that it will suit a wider range of roof pitches than conventional skylight assemblies.

According to the invention there is provided an adjustable skylight assembly adapted to suit a variety of roof pitches, said assembly comprising a sunlight receiving means adapted to be mounted on the roof and to transmit sunlight therethrough, duct means for transmitting the sunlight beneath the roof and adjustable mounting means for connecting the duct to the sunlight receiving means.

BRIEF DESCRIPTION OF THE DRAWINGS

In order that the invention may be more readily understood and put into practical effect, reference will now be made to the accompanying drawings, in which.

DESCRIPTION OF BEST MODE OF PERFORMING THE INVENTION

Figure 1:
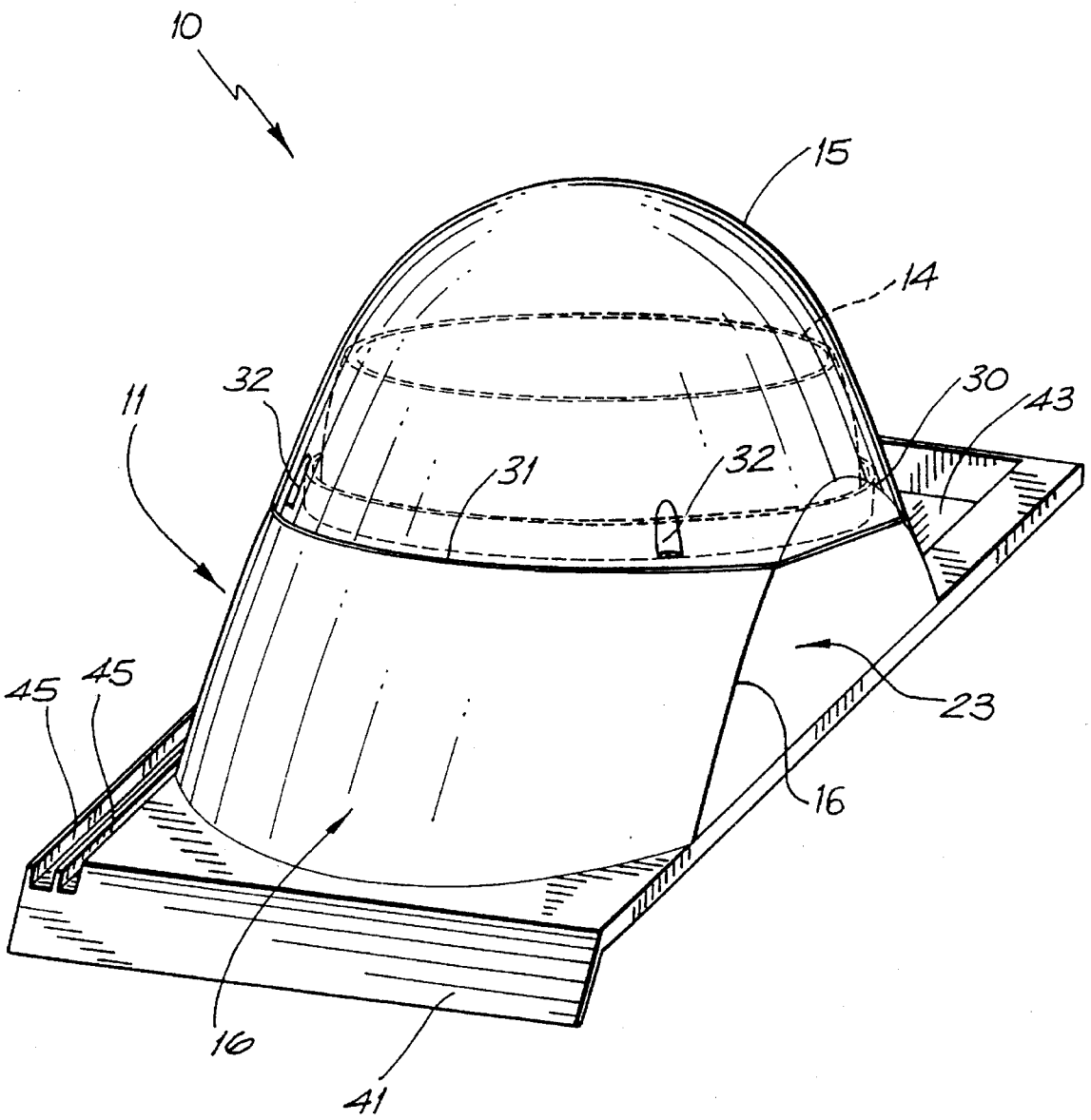
FIG. 1 is a perspective view of a skylight assembly according to a preferred embodiment of the present invention.
Figure 3:
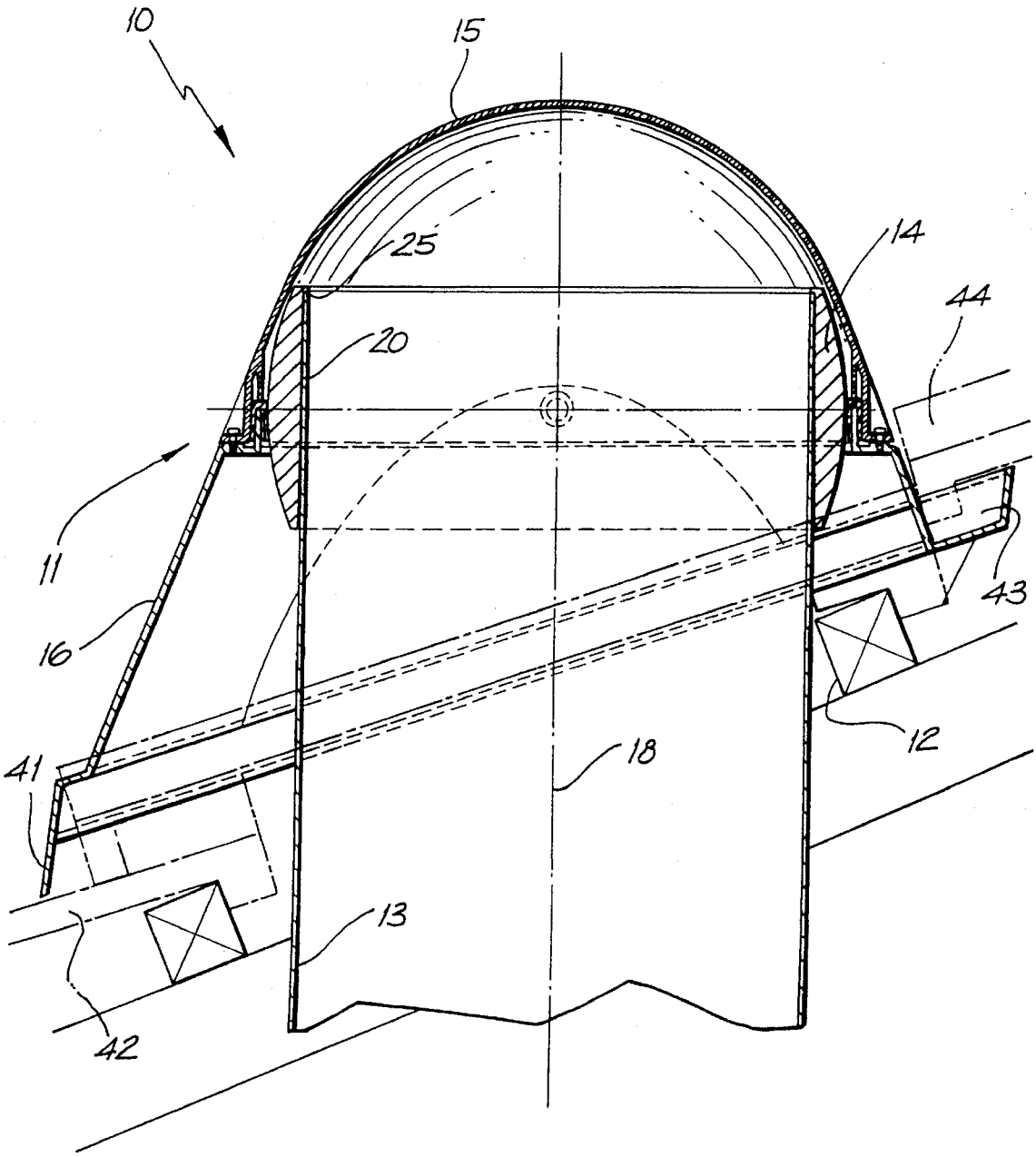
FIG. 3 is a sectional side elevational view of the skylight assembly shown in FIG. 1 mounted on a roof having an inclination of 22.5 degrees.
Figure 4:
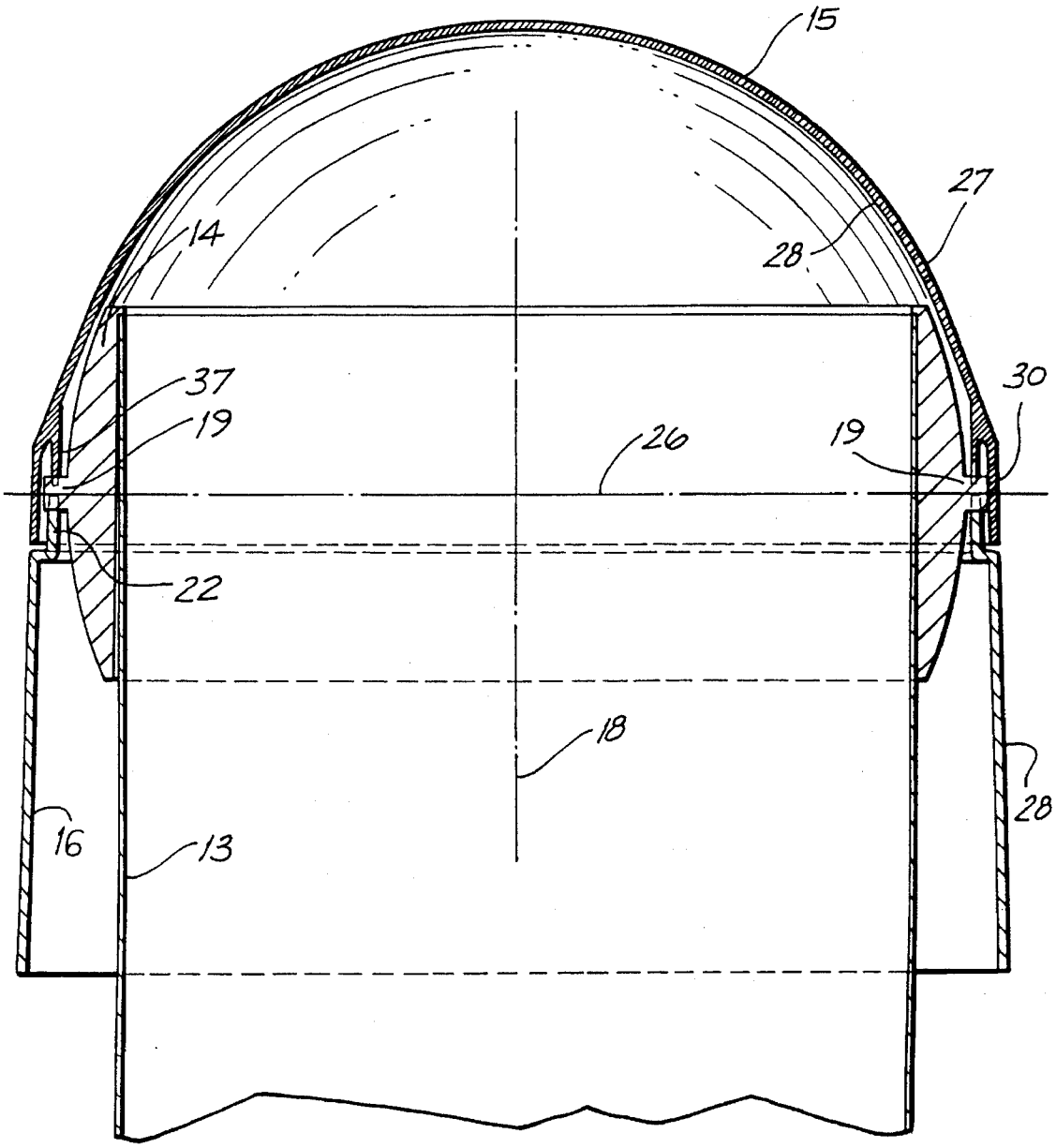
FIG. 4 is a transverse cross-sectional view of the skylight assembly shown in of FIG. 1.

The skylight assembly 10 shown in FIGS. 1 and 3, which is adapted for use with concrete roofing tiles, consists of a partly transparent sunlight receiving means in the form of a domed structure 11 that protrudes above the roof 12, a straight duct 13 (see FIG. 3) and an adjustable collar 14. The duct 13 may be of a concertina-type construction so as to allow for variable location of the domed structure 11 with respect to the room or the like beneath the roof 12 requiring illumination.

The domed structure 11 has an upper transparent portion 15 and a lower base 16. In this instance, the base 16 (shown separately in FIG. 2) includes an integrally moulded mounting platform 17, that is adapted to be sealingly mounted on the roof 12 (as shown particularly in FIG. 3, 9 and 10).

The adjustable collar 14 is located within the domed structure 11 and has a lip 25 at the top of the inner surface 20 against which the upper portion of the straight duct 13 abuts. The collar 14 and at least the upper portion of the duct 13 share a common symmetrical axis 18 which, in this instance, is vertical. The duct 13 is in light passage communication with a room or the like beneath the roof 12 requiring illumination.

The collar 14 has a pair of outwardly extending lugs 19 disposed at opposite sides thereof and which are adapted to be seated in a pair of diametrically opposed grooves 21 formed in the rim 22 of the base 16. The seating of the lugs 19 in the grooves 21 allows the collar 14 and the domed structure 11 to be rotatably adjusted with respect to one another about horizontal axis 26 (see FIGS. 3, 9 and 10).

Figure 9:
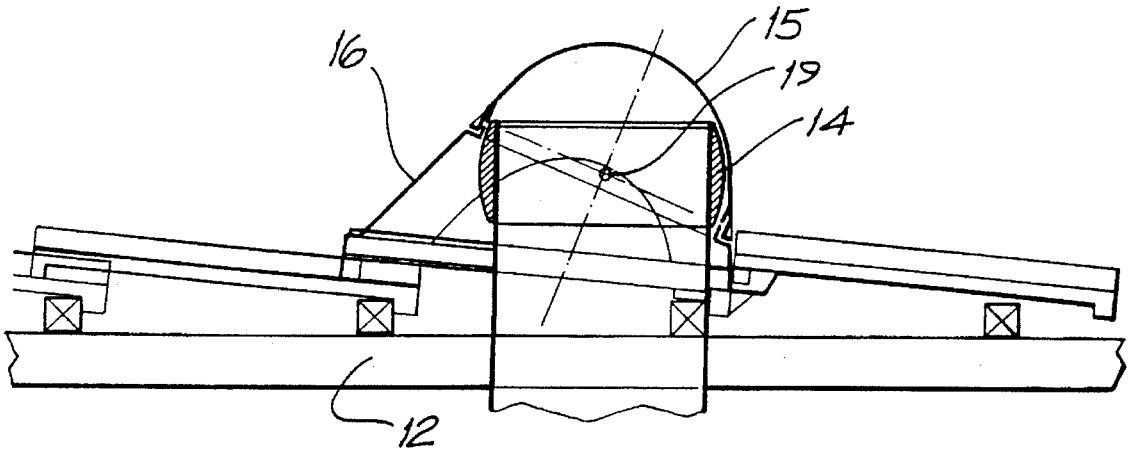
FIG. 9 is a view similar to FIG. 3 showing the skylight assembly mounted on a flat roof, and, FIG. 10 is a view similar to FIG. 3 showing the skylight assembly mounted on a roof having an inclination of 45 degrees.
Figure 10:
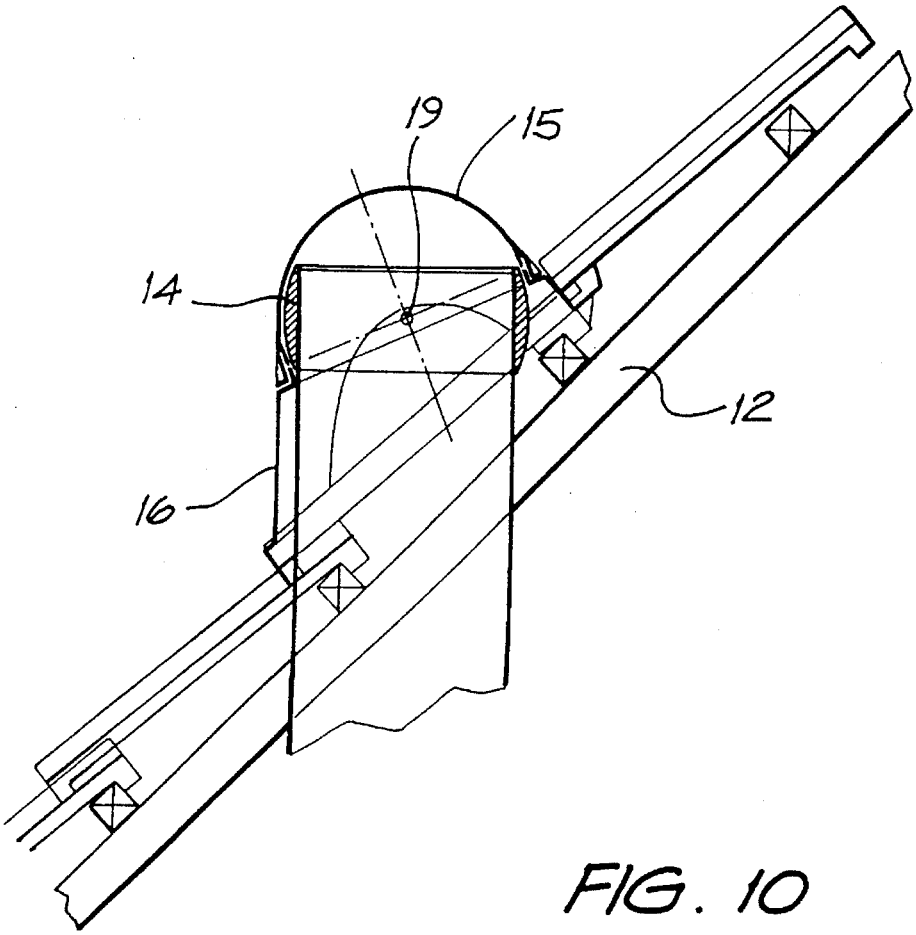

The collar 14 has an outer surface 27 that is of complementary shape to the inner surface 28 of the transparent portion 15 to permit relative rotation - see FIGS. 3, 9 and 10.

Figure 8:
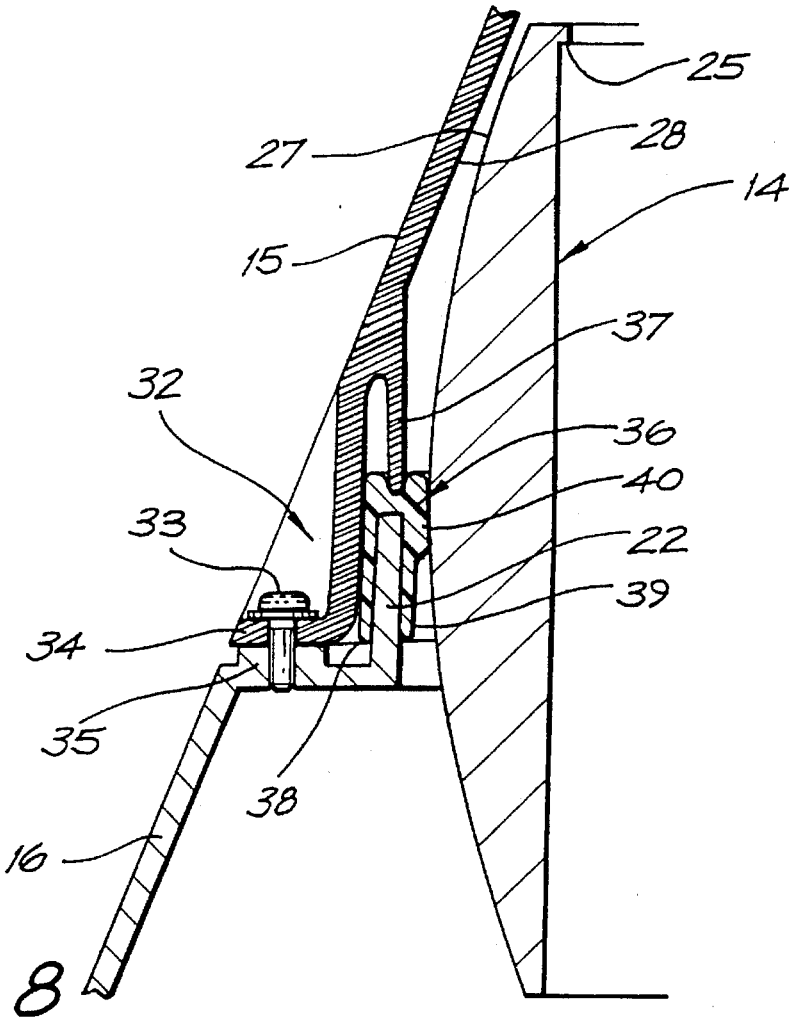
FIG. 8 is an enlarged view of part of FIG. 3 showing the junction of the lower and upper portions of the skylight assembly.

As can be clearly seen in FIG. 1, the sides 28 of the base 16 are planar so that the side extremities of the base 16 do not extend beyond the sides 29 of the mounting platform 17. The sides 30 of the upper portion 15 are also planar for the same reason. Spaced about the lower periphery 31 of the upper portion 15 are recesses 32 which receive screws 33 that secure the upper portion 15 to the base 16 by passing through connecting surfaces 34 and 35 (see FIG. 8.).

Figure 5:
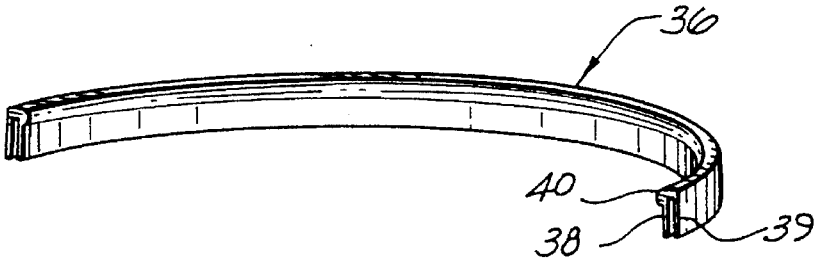
FIG. 5 is a perspective view of the sealing strip of the skylight assembly shown in FIG. 1.
Figure 6:
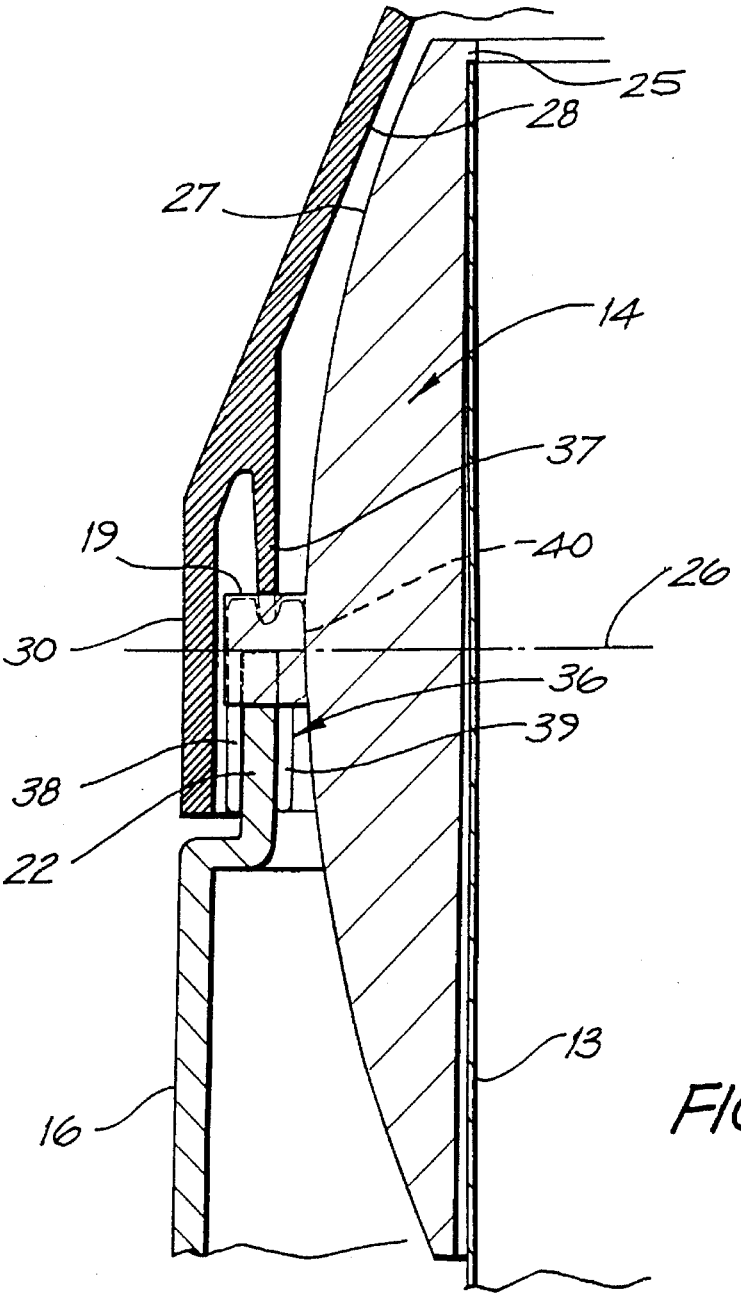
FIG. 6 is an enlarged view of part of FIG. 4 showing the junction of the lower and upper portions of the skylight assembly.
Figure 7:
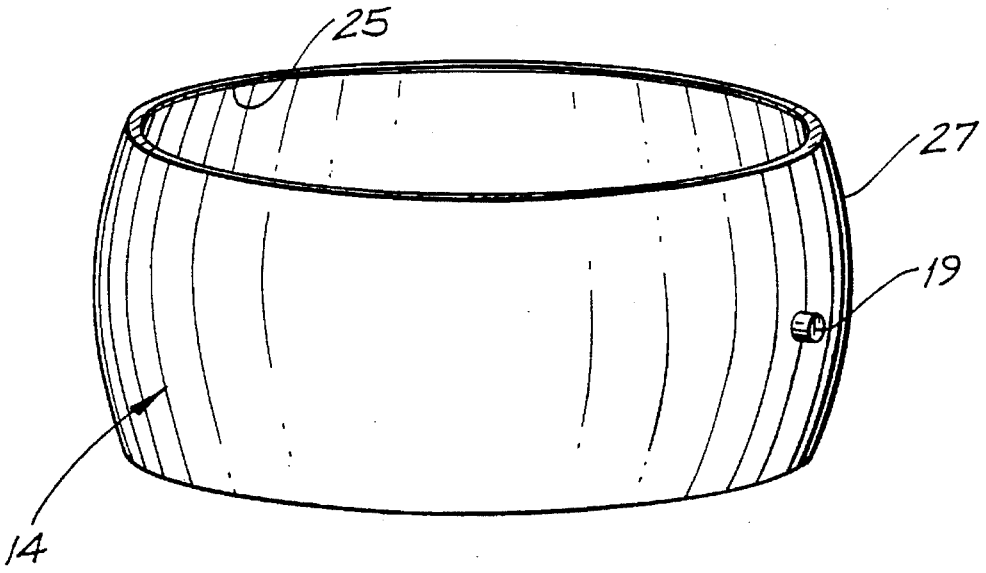
FIG. 7 is a perspective view of the adjustable collar of the skylight assembly shown in FIG. 1.

A two-part sealing strip 36 (one part of which is shown in FIG. 5) is compressed between the rim or upstanding flange 22 of the base 16 and a downwardly depending flange 37 of the upper portion 15. The sealing strip 36 has a pair of spaced apart annular portions 38, 39 which abut against the respective sides of the rim or flange 22. Projecting inwardly from the upper portion of the sealing strip is a circular bead 40 which engages against the outer surface 27 of the collar 14.

In this instance, the mounting platform 17 is so made and arranged that it may be joined to a tiled roof. To this end, the mounting platform 17 has a front sealing lip 41 adapted to be located over the upper end of the tile 42 beneath the skylight assembly 10 and a rear recess 43 adapted to receive the lower end of the tile 44 above the skylight assembly 10 (see FIG. 3). The mounting platform 17 has channels 45 on one side for receiving the edge of an adjacent tile.

Figure 2:
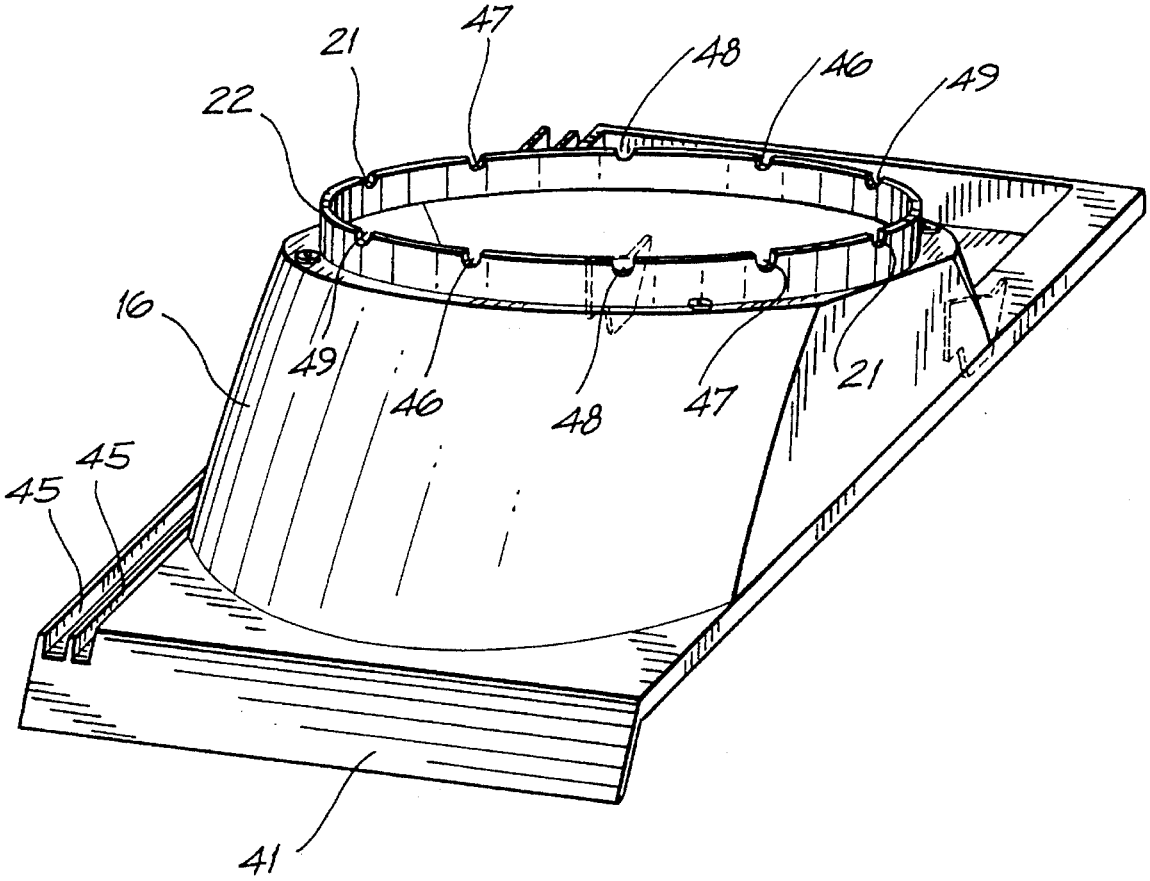
FIG. 2 is a perspective view of the lower portion of the skylight assembly shown in FIG. 1.

As can be seen in FIG. 2, the upstanding flange rim 22 of the base 16 has additional pairs of recesses 46, 47, 48 and 49 so that the collar 14 may be selectively positioned with respect to the base 16.

As shown in FIGS. 3, 9 and 10, the collar 14 and duct 13 can pivot or rotate with respect to one another about the fixed horizontal axis 26 to allow the domed structure 11 to be mounted on roofs of a variety of angular pitches and still enable the collar 14 to have its symmetrical axis in a vertical direction. In other instances, the collar 14 may be so rotated that it has its axis 18 assumes a direction at a desired angle relative to the vertical.

In the present preferred embodiment, the duct 13 has an inner lining of "Silverlux" (trade mark) that enhances the light reflectivity of the duct 13 and increases the concentration of light that passes into the room or the like requiring illumination or throughput of light. The front reflective characteristics of the "Silverlux" product further improves the throughput of light.

The upper opening of the duct 13 may also be cut at an angle which is not perpendicular to the longitudinal axis of the duct but, say, at an angle of 300° to 45° to the horizontal when the duct is vertical. This will increase the area of the duct opening through which sunlight can pass into the duct when the duct opening is orientated towards the sun.

Additionally, a refractor panel, such as an "Edpanel" (trade mark) which is a laser cut acrylic panel, may be located over the duct opening and it will cause refraction of the incident sunlight into the duct at angles which will minimize the number of reflections in the duct, thereby increasing the concentration of light that passes into the room or the like requiring illumination.

Various modifications may be made in details of design and construction without departing from the scope or ambit of the invention.

INDUSTRIAL APPLICABILITY

The adjustable skylight assembly of the invention may be mounted on conventional roofs of a variety of pitches.

I claim:

1. An adjustable skylight assembly adapted to suit a variety of roof pitches, said assembly comprising a sunlight receiving means adapted to be mounted on a roof for receiving sunlight therethrough, sunlight transmitting means for transmitting sunlight beneath the roof and rotatably adjustable mounting means for connecting the sunlight transmitting means to the sunlight receiving means.

2. An adjustable skylight assembly according to claim 1 wherein the rotatably adjustable mounting means comprises a collar mounted around an upper end of the sunlight transmitting means, said collar having a pair of opposed outwardly extending lugs that are rotatably seated within the sunlight receiving means.

3. An adjustable skylight assembly according to claim 1 wherein the sunlight receiving means includes a base portion by which it is connected to the roof and an upper portion having a light transparent portion.

4. An adjustable skylight assembly according to claim 3 wherein the base portion has an internal upwardly directed flange or rim to which the rotatably adjustable mounting means is connected.

5. An adjustable skylight assembly according to claim 3 and including sealing means between the base portion, the upper portion and the rotatably adjustably mounting means.

6. An adjustable skylight assembly according to claim 4 wherein the flange or rim has at least one pair of opposed recesses adapted to receive respective lugs on the rotatably adjustable mounting means whereby the rotatably adjustable mounting means and the sunlight receiving means are rotatable with respect to one another about a substantially horizontal axis.

7. An adjustable skylight assembly according to claim 6 wherein the flange or rim has a plurality of pairs of opposed recesses.

* * * * *